US008770155B2

(12) United States Patent
Tandra

(10) Patent No.: US 8,770,155 B2
(45) Date of Patent: Jul. 8, 2014

(54) SOOTBLOWER HAVING A NOZZLE WITH DEEP REACHING JETS AND EDGE CLEANING JETS

(75) Inventor: Danny S. Tandra, Johns Creek, GA (US)

(73) Assignee: Clyde Bergemann Power Group Americas Inc., Atlanta, GA (US)

( * ) Notice: Subject to any disclaimer, the term of this patent is extended or adjusted under 35 U.S.C. 154(b) by 930 days.

(21) Appl. No.: 12/701,805

(22) Filed: Feb. 8, 2010

(65) Prior Publication Data

US 2010/0199930 A1 Aug. 12, 2010

Related U.S. Application Data

(60) Provisional application No. 61/150,491, filed on Feb. 6, 2009.

(51) Int. Cl.
*F22B 37/48* (2006.01)

(52) U.S. Cl.
USPC ..... 122/405; 15/318

(58) Field of Classification Search
USPC ..... 122/379, 405; 15/318, 322, 316.1, 405, 15/406
See application file for complete search history.

(56) References Cited

U.S. PATENT DOCUMENTS

| | | | | | |
|---|---|---|---|---|---|
| 3,216,044 | A * | 11/1965 | Chappell | 15/317 |
| 4,407,237 | A * | 10/1983 | Merritt, Jr. | 122/390 |
| 4,503,811 | A * | 3/1985 | Hammond | 122/392 |
| 4,565,324 | A * | 1/1986 | Rebula et al. | 239/290 |
| 4,566,406 | A * | 1/1986 | Appleman | 122/405 |
| 5,423,483 | A * | 6/1995 | Schwade | 239/11 |
| 5,505,163 | A * | 4/1996 | Jameel | 122/379 |
| 5,778,831 | A * | 7/1998 | Jameel | 122/392 |
| 6,764,030 | B2 * | 7/2004 | Habib et al. | 239/566 |
| 6,892,679 | B2 * | 5/2005 | Jameel et al. | 122/379 |
| 7,028,926 | B2 * | 4/2006 | Habib et al. | 239/566 |
| 7,360,508 | B2 * | 4/2008 | Habib et al. | 122/379 |
| 2002/0121563 | A1 * | 9/2002 | Habib et al. | 239/461 |
| 2004/0222324 | A1 * | 11/2004 | Habib et al. | 239/566 |
| 2008/0250598 | A1 | 10/2008 | Holden et al. | |

FOREIGN PATENT DOCUMENTS

DE 888 737 9/1953

* cited by examiner

*Primary Examiner* — Gregory A Wilson
(74) *Attorney, Agent, or Firm* — Morris, Manning & Martin, LLP; Christopher W. Raimund

(57) ABSTRACT

A sootblower having a nozzle that includes one or more deep reaching jets aligned with its respective platen bank to clean slag deposits inset from the leading edge of the platen bank. The nozzle also includes one or more edge cleaning jets substantially angled with respect to the platen bank for cleaning the leading edges of the platen bank. For most applications, the major axis of the sootblower is perpendicular to the major axis of its respective platen bank, resulting in a sootblower with a nozzle having angled and perpendicular jets, referred to as angled-perpendicular nozzles. The jet sizes are selected to balance the opposing components of force perpendicular to the sootblower to avoid the imposition of torque on the lance.

19 Claims, 12 Drawing Sheets

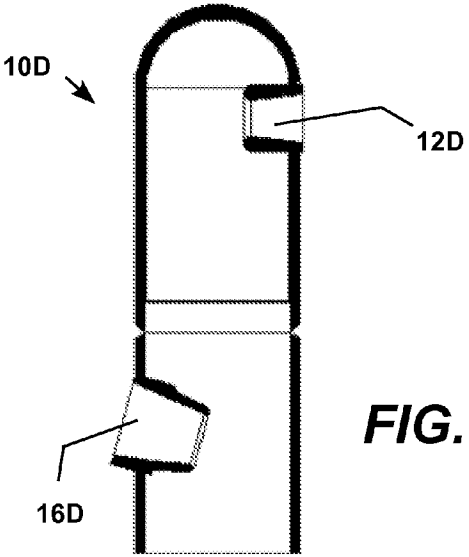
FIG. 2D
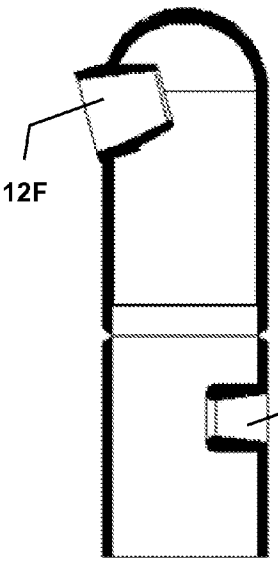
FIG. 2E
FIG. 2F

SOOTBLOWER HAVING A NOZZLE WITH DEEP REACHING JETS AND EDGE CLEANING JETS

REFERENCE TO RELATED APPLICATIONS

This application claims priority to commonly-owned copending U.S. Provisional Patent Application Ser. No. 61/150,491 entitled "L-Nozzle" filed Feb. 6, 2009, which is incorporated herein by reference.

TECHNICAL FIELD

The present invention relates to sootblowers used to clean industrial boilers and, more particularly, relates to a sootblower equipped with a nozzle having deep reaching jets and edge cleaning jets.

BACKGROUND OF THE INVENTION

Industrial boilers, such as oil-fired, coal-fired and trash-fired boilers in power plants used for electricity generation and waste incineration, as well as boilers used in paper manufacturing, oil refining, steel and aluminum smelting and other industrial enterprises, are huge structures that generate tons of ash while operating at very high combustion temperatures. These boilers are generally characterized by an enormous open furnace in a lower section of the boiler housed within walls constructed from heat exchanger tubes that carry pressurized water, which is heated by the furnace. An ash collection and disposal section is typically located below the furnace, which collects and removes the ash for disposal, typically using a hopper to collect the ash and a conveyor or rail car to transport it away for disposal. In case of pulp and paper black liquor recovery boilers, the products of the combustion in the furnace are directed to a green liquor tank to recover the inorganic cooking chemicals used in the pulping process.

A superheater section is typically located directly above the furnace, which includes a number of panels, also called platens or pendants, constructed from heat exchanger tubes that hang from the boiler roof, suspended above the combustion zone within the furnace. The superheater platens typically contain superheated steam that is heated by the furnace gas before the steam is transported to steam-driven equipment located outside the boiler, such as steam turbines or wood pulp cookers. The superheater is exposed to very high temperatures in the boiler, such as about 2800 degrees Fahrenheit [about 1500 degrees Celsius], because it is positioned directly above the combustion zone for the purpose of exchanging the heat generated by the furnace into the steam carried by the platens. The boiler also includes a number of other heat exchangers that are not located directly above the furnace, and for this reason operate at lower temperatures, such as about 1000-1500 degrees Fahrenheit [about 500-750 degrees Celsius]. These boiler sections may be referred to as a convection zone typically including one or more pre-heaters, re-heaters, superheaters, and economizers.

There is a high demand for thermal energy produced by these large industrial boilers, and they exhibit a high cost associated with shutting down and subsequently bringing the boilers back up to operating temperatures. For these reasons, the boilers preferably run continuously for long periods of time, such as months, between shut down periods. This means that large amounts of ash, which is continuously generated by the boiler, must be removed while the boiler remains in operation. Further, fly ash tends to adhere and solidify into slag that accumulates on high-temperature interior boiler structures, including the furnace walls, the superheater platens, and the other heat exchangers of the boiler. If the slag is not effectively removed while the boiler remains in operation, it can accumulate to such an extent that it significantly reduces the heat transfer capability of the boiler, which reduces the thermal output and economic value of the boiler. In addition, large unchecked accumulations of slag can cause huge chunks of slag to break loose, particularly from the platens, which fall through the boiler and can cause catastrophic damage and failure of the boiler.

The slag accumulation problem in many conventional boilers has been exacerbated in recent years by increasingly stringent air quality standards, which have mandated a change to coal with a lower sulphur content. This low-sulphur coal has a higher ash content and produces more tenacious slag deposits that accumulate more quickly and are more difficult to remove, particularly from the superheater platens. To combat this problem, the industry has developed increasingly sophisticated boiler cleaning equipment that operates continually while the boiler remains in operation. In particular, water cannons can be periodically used to clean the boiler walls in the open furnace section, and steam, water, air, and multi-media sootblowers can be used to clean the heat exchangers. These sootblowers generally include lance tubes that are inserted into the boiler adjacent to the heat exchangers and operate like large pressure washers to clean the heat exchangers with steam, water, air or multi-media blasts while the boiler remains in operation.

Fireside deposit accumulation in both power and recovery boilers not only reduces the boiler thermal efficiency, but can also lead to costly unscheduled shutdown due to the plugging of the gas passages. Although full plugging of the gas passages in power boilers can be considered a rare case, localized plugging can significantly accelerate the gas velocity and increase the risk of tube erosion.

Generally, sootblowers are configured with balanced jets to minimize the torque imposed on the sootblower lance. A first type of conventional sootblower has perpendicular nozzles with jets directed at opposing right angles to the major axis of the sootblower. Sootblowers with perpendicular nozzles work well at removing thin slag deposits and deposits inset from the leading edges of the platens but are less effective at removing thick slag deposits on the leading edges. An alternative type of conventional sootblower has lead-lag nozzles with jets directed at opposing acute angles to the major axis of the sootblower. Sootblowers with lead-lag nozzles work well at removing thick deposits on the leading edges of the platens but are less effective at removing thin deposits and slag deposits inset from the leading edges. At present, there is a need for a sootblower that successfully removes thick slag deposits on the leading edges of the platens, thin deposits on the leading edges, as well as slag deposits inset from the leading edges of the platens.

SUMMARY OF THE INVENTION

The present invention meets the needs described above in a sootblower having a nozzle that includes one or more deep reaching jets aligned with its respective platen bank to clean slag deposits inset from the leading edge of the platen bank. The nozzle also includes one or more edge cleaning jets substantially angled with respect to the platen bank for cleaning the leading edges of the platen bank. For most applications, the major axis of the sootblower is perpendicular to the major axis of its respective platen bank, resulting in a sootblower with a nozzle having angled and perpendicular jets, referred to as angled-perpendicular nozzles.

The jet sizes are selected to balance the opposing components of force perpendicular to the major axis of the sootblower to avoid the imposition of torque on the sootblower lance. As a result, the angled jet size increases as the angle increases from perpendicular to the major axis of the sootblower. The desired jet angle is also a function of the distance between adjacent platens to be cleaned, resulting in a range of jet angles and jet sizes appropriate for different boiler configurations and, potentially, different location within a boiler. Sootblowers with different lengths and diameters can be configured with the angled-perpendicular nozzles on new equipment and retrofit bases.

BRIEF DESCRIPTION OF THE DRAWINGS

FIG. 2D is a cross-sectional side view of a second alternative for an angled-perpendicular sootblower nozzle in which the outward jet is perpendicular and the inner jet is angled outward.

FIG. 2E is a cross-sectional side view of a third alternative for an angled-perpendicular sootblower nozzle in which the outward jet is perpendicular and the inner jet is angled inward.

FIG. 2F is a cross-sectional side view of a fourth alternative for an angled-perpendicular sootblower nozzle in which the outward jet is angled inward and the inner jet is perpendicular.

DETAILED DESCRIPTION OF THE EMBODIMENTS

Figure 1C:
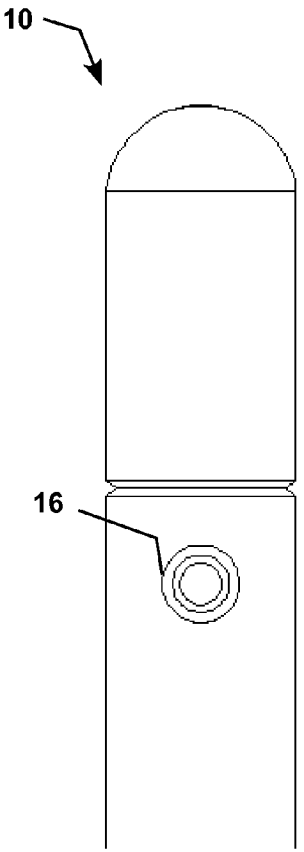
FIG. 1C is a rear view of the angled-perpendicular sootblower nozzle.

The present invention may be embodied as improvements to water sootblowers, steam sootblowers, air sootblowers and multi-media sootblowers, such as those described in U.S. Pat. Nos. 6,892,679 and 7,367,079, which are incorporated herein by reference. Because sootblowers are typically installed as permanent equipment in power plants, the invention may be deployed as an angled-perpendicular nozzle for a sootblower, a retrofit angled-perpendicular nozzle for an existing sootblower, a sootblower with an angled-perpendicular nozzle, and as a power plant boiler having one or more sootblowers with angled-perpendicular nozzles installed as new or retrofit equipment.

Brittle break-up and debonding are the two most important deposit removal mechanisms by sootblower jets. Brittle break-up occurs when the stress exerted by the fluid stream emitted by the sootblower jet on the deposit S(jet) is powerful enough to fracture the deposit and/or to enlarge the existing cracks around the jet/deposit impact point. The deposit is detached from the boiler tube when the propagation of the crack reaches the deposit/boiler tube interface and the crack is enlarged by the act of circumferential tensile stress and the shear stress developed by the fluid stream emitted by the sootblower jet. This mechanism can only take place if S(jet) exceeds the deposit tensile strength S(tensile).

Debonding is a deposit removal mechanism that relies on weak deposit adhesion strength S(adhesion) at the interface between the deposit and the tube (platen) surface. To remove a deposit with debonding, the S(jet) has to be greater than the S(adhesion). A deposit with high tensile strength S(tensile) can be dislodged from the tube, even with a relatively weak sootblower jet force, providing that the fluid stream can overcome the S(adhesion).

The brittle break-up deposit removal criteria for thin layer of deposit strongly attached to a boiler tube is:

$$P(\text{jet}) > \frac{1-\nu}{1-2\nu} S(\text{tensile}) \tag{1}$$

While, for a thick layer of deposit, the deposit removal criteria is as follows $$P(\text{jet}) > \frac{2}{1-2v} S(\text{tensile}) \quad (2)$$

where:

P(jet)=Sootblower jet stagnation pressure at the jet/deposit impact point v=Deposit Poisson's ratio S(tensile)=Deposit tensile strength The fluid stream power required to break a brittle deposit increases with the thickness of the deposit. In other words, it is more difficult to remove thick deposits than thin deposits with the brittle break-up mechanism. For a typical slag deposit having a Poisson's ratio of v=0.2, the removal criteria for thin layer, equation (1), becomes P>1.33 S(tensile) and the removal criteria for thick layer, equation (2), reduces to P>3.33 S(tensile). In this case, the fluid stream power required to remove a thick deposit with a Poisson's ratio v=0.2 is two and a half times higher than that required for a thin deposit. In addition, for a thick deposit, the tensile stress created by the sootblower fluid stream drops quickly from the region where the fluid stream impacts the deposit. As a result, the crack created by the fluid stream may not be able to penetrate deep into deposit/boiler tube interface. Hence, only a small portion of the deposit may be removed by the sootblower.

Unlike brittle break-up, it is easier to remove thick deposits than thin deposits by debonding. Analysis of stresses at the interface between the deposit and tube shows that removal criteria for debonding may be represented as follows:

$$P(\text{jet}) > \Psi S(\text{adhesion}) \frac{D(\text{tube})}{h(\text{deposit})} \quad (3)$$

where:

P(jet)=Sootblower jet stagnation pressure at the jet/deposit impact point

Ψ=A coefficient which depends on deposit shape and interface area

Ψ≈1 for deposit that covers half of the tube circumference

S(adhesion)=Deposit adhesion strength

Figure 1B:
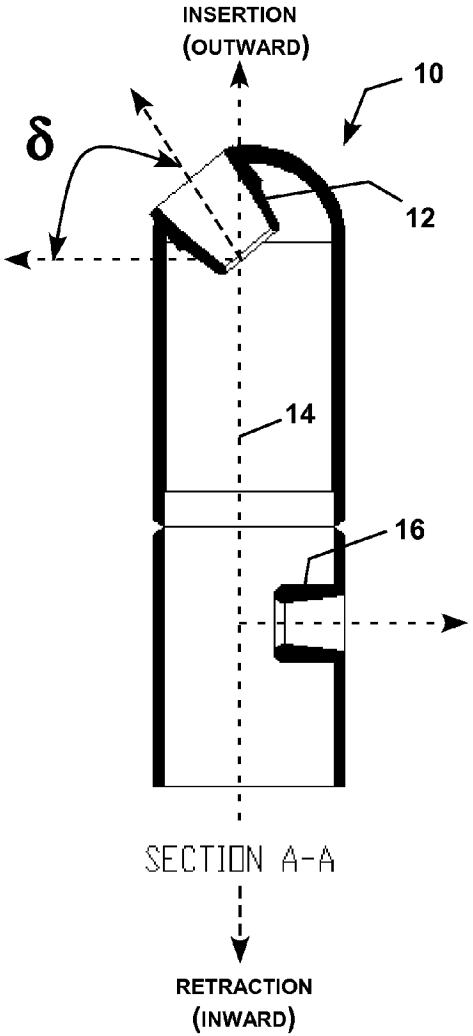
FIG. 1B is a cross-sectional side view of the angled-perpendicular sootblower nozzle.

D(tube)=Tube diameter h(deposit)=Deposit thickness as shown in FIG. 1*b*

As seen in equation (3), h(deposit) is located in the denominator of the equation. Hence, the thicker the deposit, the easier it is to remove by debonding. This principle can also be understood by evaluating the torque exerted by the fluid stream on thick versus thin deposits. The torque experienced by the deposit is proportional to the magnitude of the fluid stream force times the moment arm of the force, which makes thick deposits easier to remove by debonding due to the larger moment arm created by the thickness of the deposit. The conclusion is that brittle break-up mechanism is generally more effective in removing thin and small deposits, while debonding is generally more effective in removing thick and large deposits.

Plugging in the convection section of a recovery boiler generally starts from the deposit accumulation on the leading edges at the entrance of a tube bank. These deposits are typically responsible for the plugging of a recover boiler, especially in the superheater section. Nevertheless, conventional sootblowers with perpendicular nozzles generally consist of two 180° opposing nozzles directed in alignment with the platen bank, which is typically perpendicular to the major axis of the sootblower (i.e., the direction of lance insertion and retraction). Because of this nozzle arrangement, conventional sootblowers are only configured to remove the leading-edge deposits with the brittle break-up mechanism. The fluid stream emitted by the perpendicular jet, which exerts a force parallel to the gas flow, aligned with the platen bank, and perpendicular to the deposit, hits the deposit and pushes it against the leading edge of the tube. Hence, there is no significant toque or shear force produced by the perpendicular jet to promote the debonding removal mechanism. Since the deposits accumulated on the leading edge of a tube bank are generally fast-growing and thick, the brittle break-up mechanism is ineffective in removing the deposits. This shortcoming of sootblowers with perpendicular jets has been confirmed by many boiler inspections carried out using high temperature infrared cameras.

In regions where the deposit temperature is above 662° F. (350° C.), the deposit adhesion strength S(adhesion) is generally significantly smaller than the deposit tensile strength S(tensile). This suggests that it would be more effective to remove deposits in the superheater or hot-side of the generating bank with debonding rather than brittle break-up. Some sootblowers, mainly for coal fired boiler applications, are designed with a lead-lag nozzle to promote the debonding removal mechanism. Although the lead-lag nozzle arrangement may be effective in removing deposits that are accumulating on the leading edge of the tube, lead-lag nozzles are not effective in removing thin deposits and may fail to penetrate deep down into the tube bank passage where the deposits are inset from the leading edges of the platens. This is especially true for recovery boilers that have tight platen spacing, typically 10 inches (24.5 cm) between platens. In this case, the deposit located deep inside the tube bank may accumulate and plug the banks inset from the leading edges of the platens.

Figure 1A:
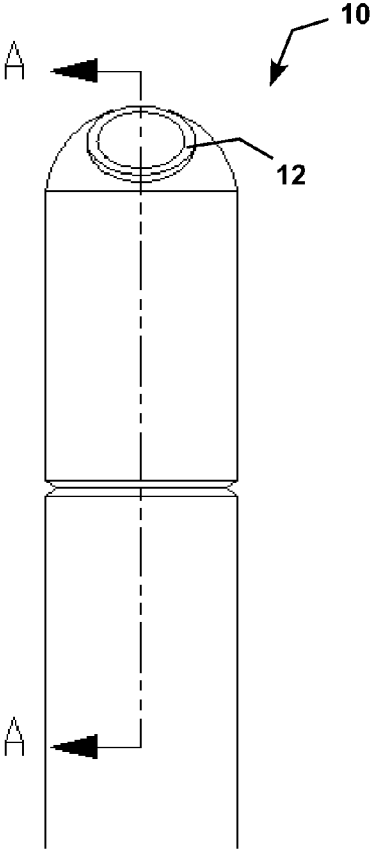
FIG. 1A is a front view of an angled-perpendicular nozzle for a sootblower for use in a boiler in an industrial power plant.

The new angled-perpendicular nozzle equips the sootblower with a perpendicular jet to remove thin leading-edge deposits with brittle break-up and to also reach deposits inset from the leading edges of the platens, along with an angled jet for removing thick deposits on the leading edges of the platens through debonding. As shown in FIGS. 1A-1C, the angled-perpendicular sootblower nozzle 10 includes a first jet 12 directed at an angle (δ) with respect to perpendicular to the major axis 14 of the sootblower and a second jet 16 directed perpendicular to the major axis of the sootblower. The main role of the angled jet 12 is to deal with the deposit accumulation on the leading edges of the tubes (platens) by promoting the debonding removal mechanism with shear force. The main roles of the straight or perpendicular jet 16, on the other hand, is to deal with deposits that are more efficient to be removed with brittle break-up mechanism, such as those that are small in size or thin on the leading edges of the platens, and to generate a fluid stream perpendicular to the sootblower major axis that penetrates deep into the tube bank to control the deposit accumulation inside the banks inset from the leading edges of the platens.

Figures 2A, 2B, 2C:
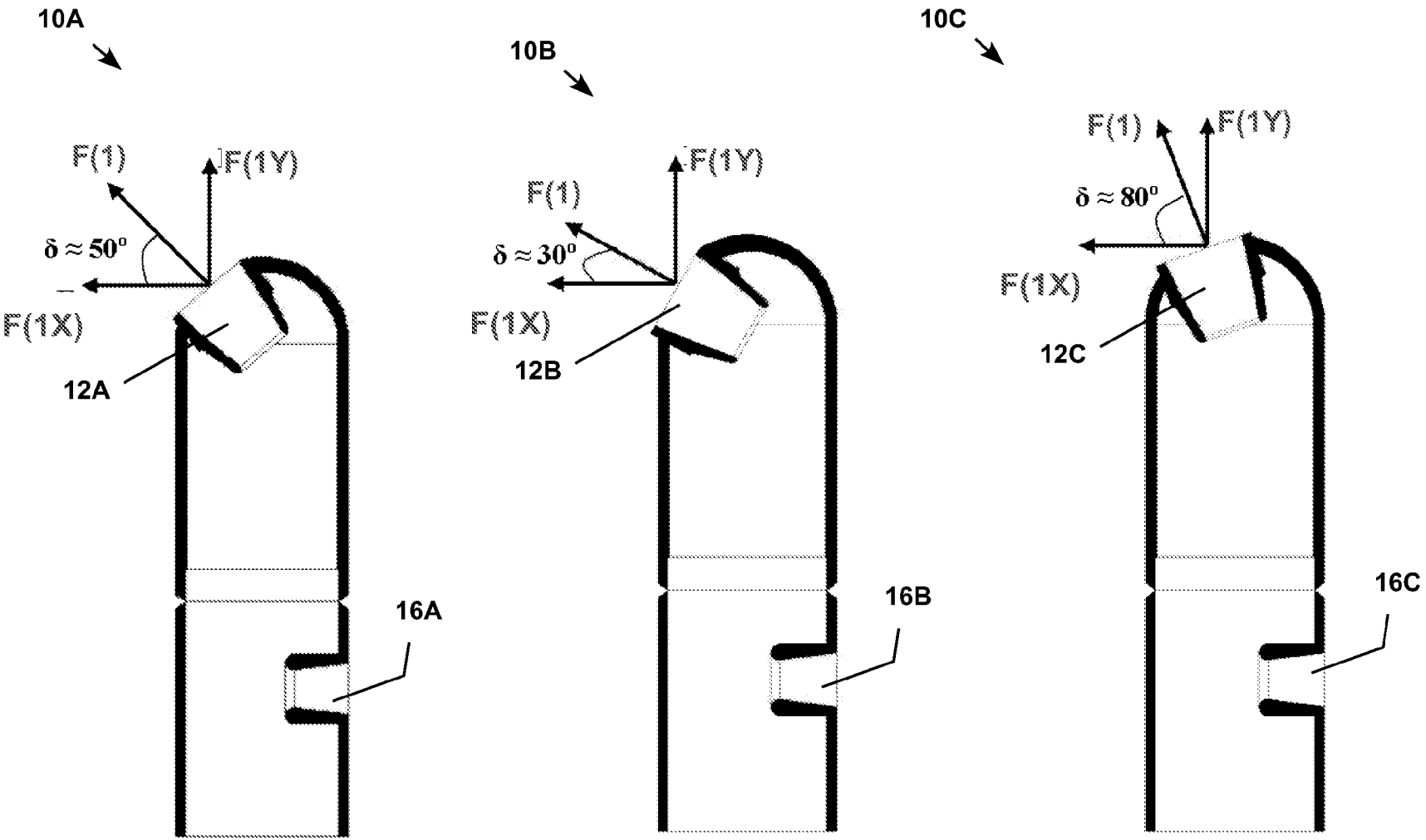
FIG. 2A is a cross-sectional side view of a first alternative for an angled-perpendicular sootblower nozzle in which the outward jet is angled and the inner jet is perpendicular.
FIG. 2B is a cross-sectional side view of the angled-perpendicular sootblower nozzle in which the angled jet has a minimal angle considered to be the lower end of the practical range for the jet angle.
FIG. 2C is a cross-sectional side view of an angled-perpendicular sootblower nozzle in which the angled jet has a maximum angle considered to be the upper end of the practical range for the jet angle.

FIG. 2A illustrates an angled-perpendicular sootblower nozzle 10A with a perpendicular jet 16A and an angled jet 12A having a typical jet angle (δ) equal to 50 degrees, which has been found to be appropriate in most cases. FIG. 2B illustrates an angled-perpendicular sootblower nozzle 10B with a perpendicular jet 16B and an angled jet 12B having a jet angle (δ) equal to 30 degrees, and FIG. 2C illustrates an angled-perpendicular sootblower nozzle 10C with a perpendicular jet 16C and an angled jet 12C having a jet angle (δ) equal to 80 degrees. In general, the practical range of the jet angle (δ) is considered to be from about 30 degrees, as shown in FIG. 2B, to about 80 degrees, as shown in FIG. 2C, with about 50 degrees, as shown in FIG. 2A, to be appropriate in most cases.

In the embodiments show in FIGS. 1A-1C, the outer jet (i.e., the jet toward the direction of lance insertion) provides the angled jet 12 and is angled outward, while the inner jet (i.e., the jet toward the direction of lance retraction) provides the perpendicular jet 16. It should be appreciated that either the outer or the inner jet may be angled, and that the jet angle may be directed inward or outward. FIG. 2D shows as alternative nozzle 10D with a perpendicular outer jet 12D and an inner angled jet 16D directed outward. FIG. 2E shows as alternative nozzle 10E with a perpendicular outer jet 12E and an inner angled jet 16E directed inward. FIG. 2F shows as alternative nozzle 10F with an angled outer jet 12F directed inward and an outer perpendicular jet 16F. Of course, additional jets at the same or different angles could be provided, although it is generally desirable to minimize the number of jets in order to minimize the consumption of valuable blowing fluid that flows through the jets provided.

Figure 3A:
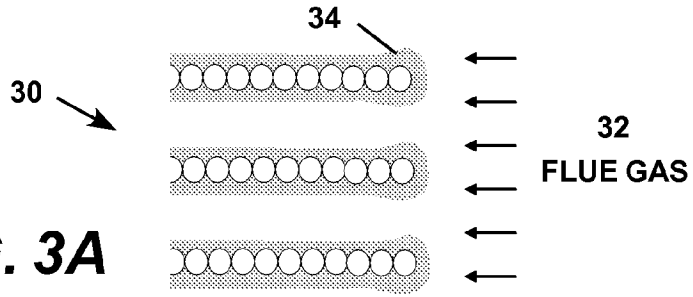
FIG. 3A is a conceptual illustration of stage-1 of slag accumulation in a boiler.
Figure 3B:
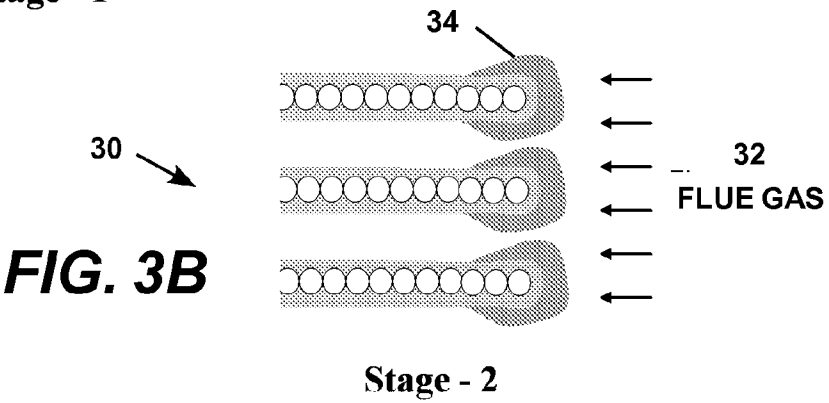
FIG. 3B is a conceptual illustration of stage-2 of slag accumulation in a boiler.
Figure 3C:
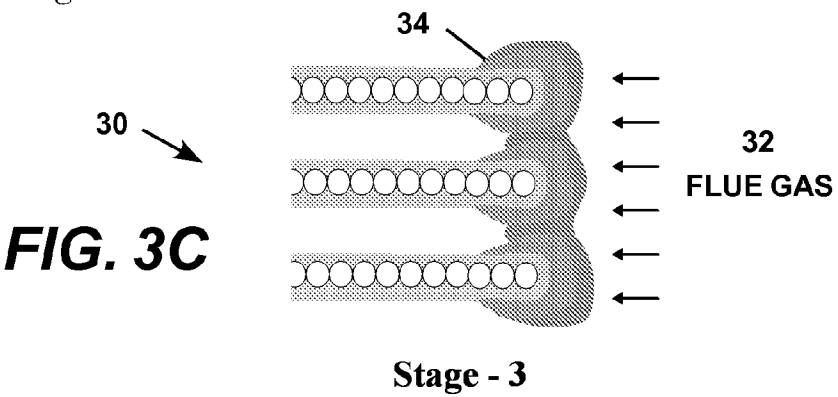
FIG. 3C is a conceptual illustration of stage-3 of slag accumulation in a boiler.
Figure 4A:
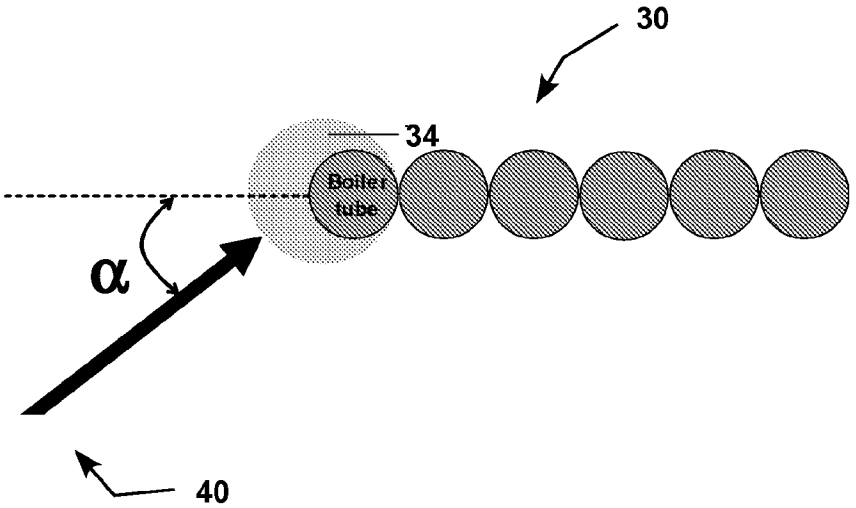
FIG. 4A is a conceptual illustration of the cleaning operation of the angled jet of a sootblower including the angled-perpendicular nozzle.
Figure 4B:
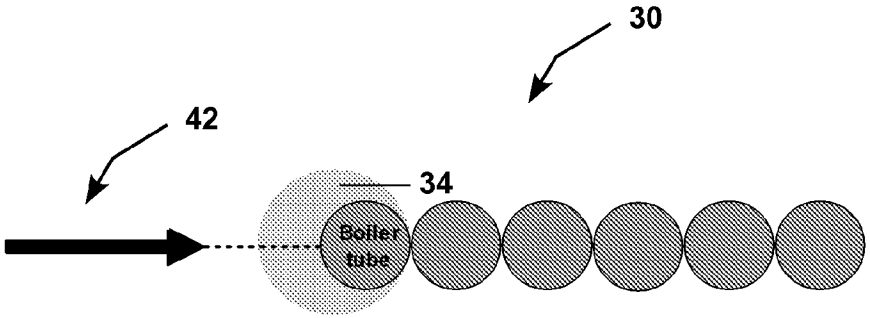
FIG. 4B is a conceptual illustration of the cleaning operation of the perpendicular jet of a sootblower including the angled-perpendicular nozzle.

FIGS. 3A-3C illustrate boiler tube platens 30 and the flow direction of flue gas 32 causing the build up of slag deposits 34 on the leading edges of the platens. Should the deposits become sufficient to fuse across the opening between the platens, as shown in FIG. 3C, the flue gas passage between the platens would become fully blocked. While this level of blockage may be rare, FIGS. 3A-3C illustrate the conceptual situation of thick deposits forming on the leading edges of the platens 30 that are most effectively removed with an angled fluid stream that imparts shear force on the deposit to promote the debonding removal mechanism. FIG. 4A illustrates the acute angle of attack $\alpha$ (i.e., 90° minus $\delta$) of the fluid stream 40 emitted by the angled jet, while FIG. 4B illustrates the "head on" or perpendicular angle of attack of the fluid stream 42 emitted by the perpendicular jet.

Figure 5:
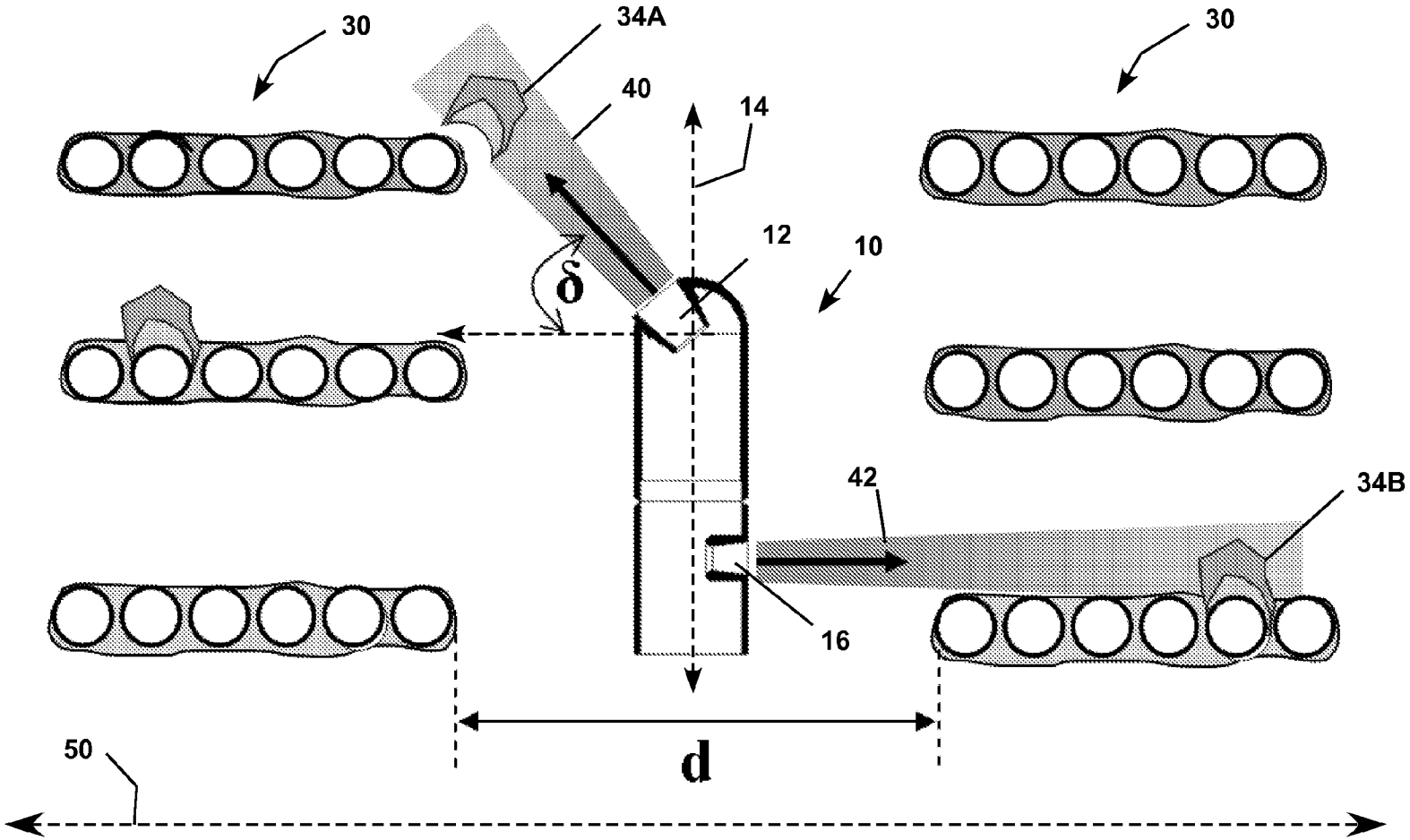
FIG. 5 is a conceptual illustration of the design and operation of an angled-perpendicular sootblower nozzle.
Figure 6:
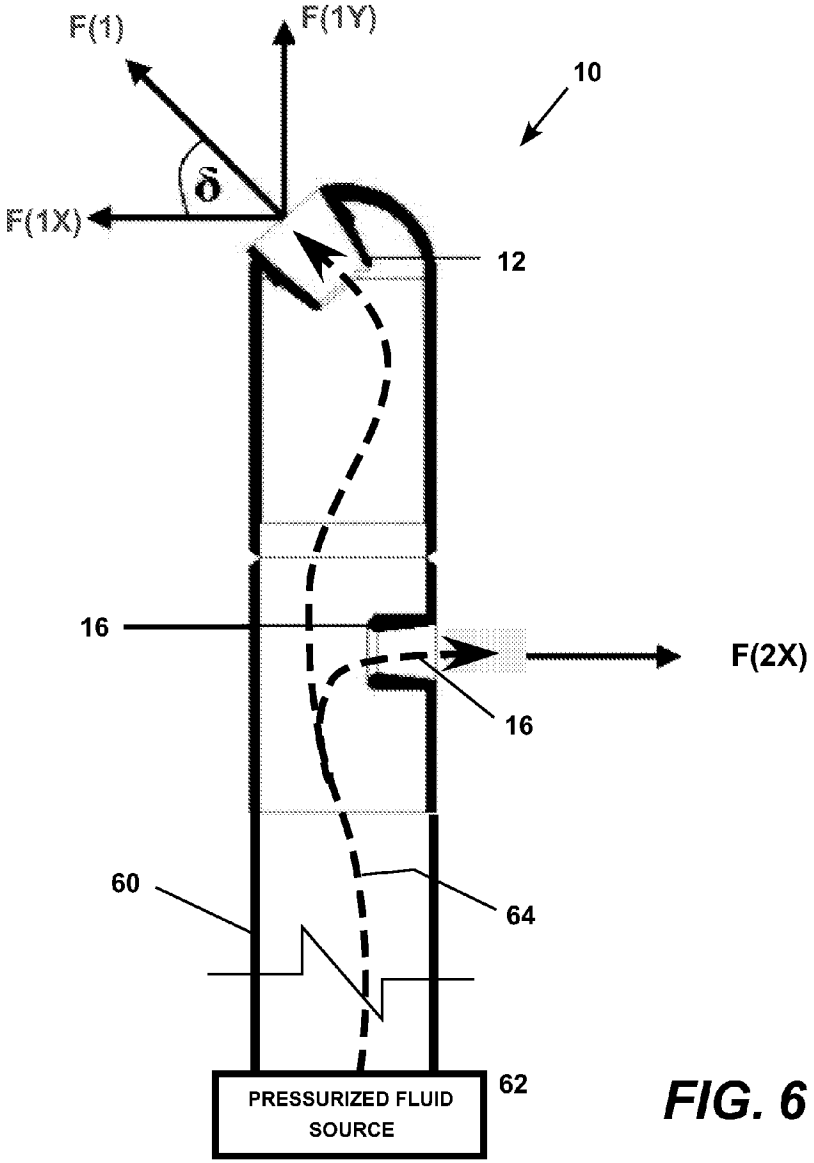
FIG. 6 is conceptual illustration of the balanced lateral forces in an angled-perpendicular sootblower nozzle.
Figure 7:
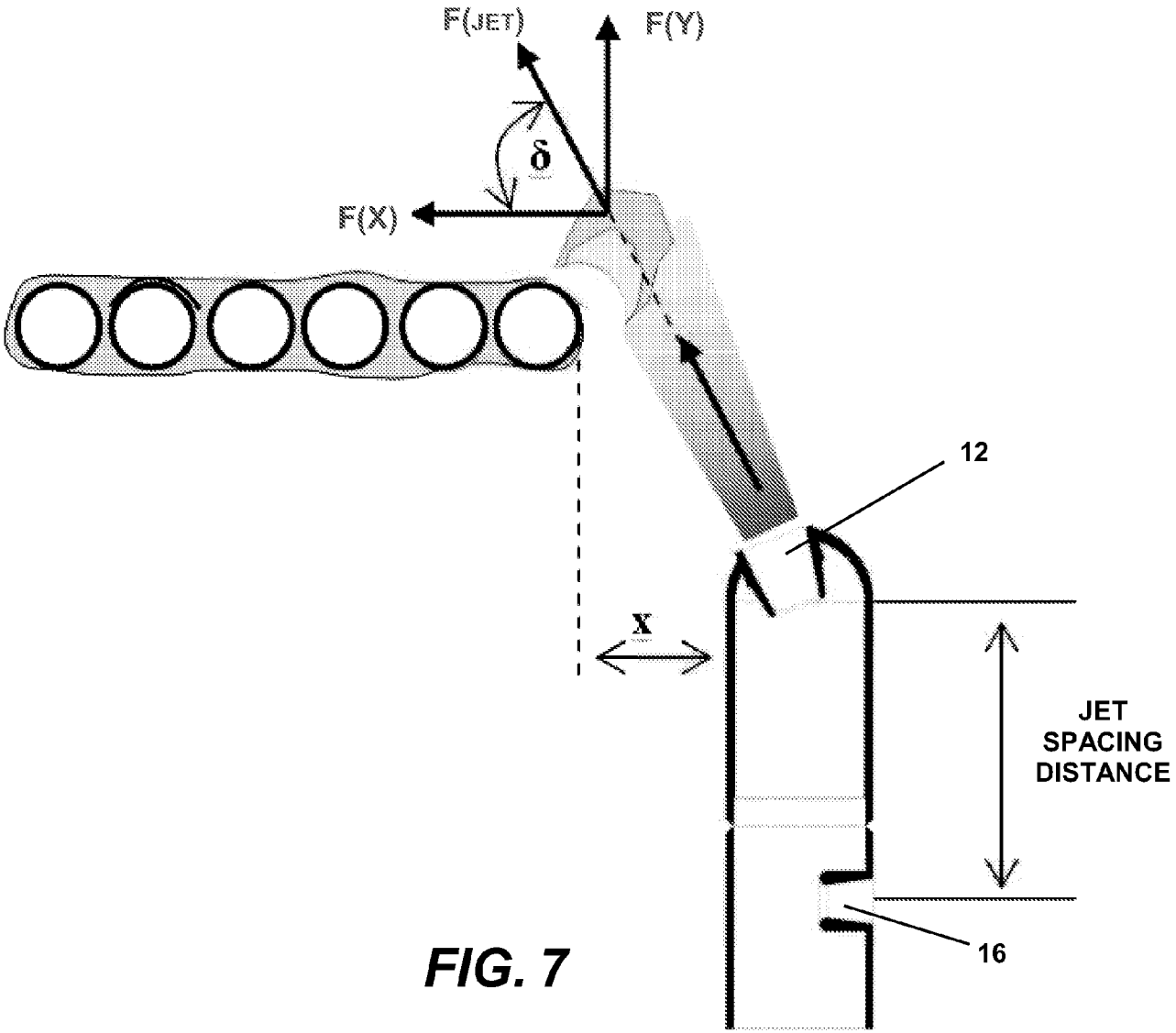
FIG. 7 is a conceptual illustration of cleaning forces for an angled-perpendicular sootblower nozzle.

FIGS. 5, 6 and 7 illustrate the cleaning operation and design of the angled-perpendicular sootblower nozzle 10. The sootblower lance, which rotates as it is inserted into and retracted from the boiler, removes accumulated slag deposits from the tube platens 30. The platens 30 are typically arranged in banks of large flat plates aligned with a major axis 50 of the platen bank, as shown in FIG. 5. The platen spacing can be quite narrow, typically 10 inches (24.5 cm) in recovery boilers. The sootblower is typically located between two adjacent platen banks with the major axis of the sootblower (i.e., the direction of insertion and retraction) perpendicular to the major axis 50 of the platen bank. For this configuration, the angled sootblower jet 12 is directed at a significant angle, typically in the range of 30 degrees to 80 degrees, to the major axis of the platen bank 50 so that the fluid stream 40 emitted by the angled sootblower jet 12 creates shear force to remove thick slag deposits on the leading edges of the platens through the debonding mechanism, as represented by the slag deposit 34A shown in FIG. 5. At the same time, the perpendicular sootblower jet 16 is aligned with the major axis of the platen bank 50, which is perpendicular to the major axis 14 of the sootblower. Aligning the sootblower jet 16 with the major axis of the platen bank 50 allows the fluid stream 42 emitted from the sootblower jet 16 to reach deeply into the platen bank to remove slag deposits inset from the leading edges of the platens, as represented by the slag deposit 34B shown in FIG. 5. The aligned fluid stream 42 emitted from the sootblower jet 16 also removes thin slag deposits on the leading edges of the platens 30 through the brittle break-up mechanism.

The angled-perpendicular nozzle 10 is located at the end of a lance tube 60 that communicates a pressurized fluid 64, which may be steam for the lance sootblower shown in FIG. 6 without internal water conduits, from a pressurized fluid source 62. The pressurized fluid typically fills the internal cavity of the lance tube 60 and the nozzle 10. The fluid then exits through the jets 12, 16. Although a steam sootblower is shown in FIG. 5, the principles of the invention are applicable to air sootblowers, water sootblowers, in which the lance tube and nozzle typically house water conduits, and multi-media sootblowers in which the sootblower the lance tube and nozzle typically house water conduits and pressurized steam or air that fills the internal cavity of the lance tube and the nozzle. As illustrated in FIG. 5, the angled jet 12 emits an angled fluid stream 40 and the perpendicular jet 16 emits a perpendicular fluid stream 42. The angled fluid stream 40 is effective at imparting shear force to remove the thick deposit 34A on the leading edge of the platen using debonding, whereas the perpendicular fluid stream 42 is effective at removing thin deposits on the leading edges via brittle break-up and for reaching deeply into the banks between platens to remove the deep deposit 34B inset from the leading edges of the platens.

Although FIG. 5 illustrates the typical platen configuration, the major axis of the platen bank could be angled with respect to the major axis of the sootblower. For this configuration, one of the sootblower jets would be aligned with the major axis of the platen bank and the other sootblower jet would be directed at a significant angle, typically in the range of 30 degrees to 80 degrees, to the major axis of the platen bank. In most cases, this results in a sootblower nozzle with one jet perpendicular to the major axis of the sootblower and one jet at angled 30 degrees to 80 degrees with respect to perpendicular to the major axis of the sootblower. This is because the major axis of the sootblower is usually perpendicular to the major axis of the platen bank that it is designed to clean. If the angle between the major axis of the sootblower is not perpendicular to the major axis of the platen bank, the jet angles of the sootblower nozzle are adjusted so that one jet is aligned with the major axis of the platen bank and the other jet is directed at the desired angle to the major axis of the platen bank.

Referring to FIGS. 6 and 7, to determine the nozzle angle ($\delta$), the jet force required to remove the deposit 34A by debonding F(y) as shown in FIG. 7, which is a function of the deposit tenacity) is estimated. The jet force F(jet) produced by the angled fluid stream 40, which is a function of the supply pressure of the blowing medium, the internal shape of the angled jet, and the lance diameter, is selected to be sufficient to safely overcome the debonding force F(y), which is typically estimated through laboratory, field tests and experience. In general, the debonding force F(y) required to remove a tenacious deposit by debonding is in the range of 120 to 200 lbf, while the F(jet) is typically in the range of 200-300 lbf to provide a reasonable margin of certainty.

Since the two jets have different angles of attack, the resultant forces have to be balanced in the opposing perpendicular directions to prevent the imposition of torque on the sootblower lance. In order to balance the jet force, the angled jet 12 is designed with a larger throat diameter than the straight jet 16 counterpart or by manipulating the shape factor ($\beta$) to equalize the perpendicular component of force imparted by the angled jet F(1×) with the opposing perpendicular component of force imparted by the perpendicular jet F(2×):

$$F(1\times)=F(1)\cos\delta=\beta F(2\times) \tag{4}$$

where $\beta$ is a shape factor, which depends on the nozzle configuration, such as the distance between the two nozzles, lance diameter, nozzle size, etc. In practice, $\beta$ approaches one for design purposes as the lance diameter increases. The nozzle angle (δ) should be designed to create maximum debonding effects on the leading edge deposits 34A. The smaller the distance between the upstream and downstream tube banks (d as shown in FIG. 5) and the thicker the deposit buildup on the leading edge of the bank, the greater the δ required to provide significant debonding effects. The jet angle is constrained, however, by the fact that greater fluid flow has to be diverted to the angled jet as the angle from perpendicular increases to balance the lateral forces from the jets.

As a specific example, if it is determined for a certain area in a boiler that the debonding force F(y) is 155 lbf, the F(jet) is 200 lbf, and β (the shape factor) is assumed to be 1, the jet angle (δ) can be calculated as follows $$\delta = \sin^{-1}\frac{F(y)}{F(\text{jet})} = \sin^{-1}\frac{155\ \text{lbf}}{200\ \text{lbf}} = 50.8°$$

For this example, the angled jet may be designed with a throat diameter of 1.25 inches (3.175 cm). The throat diameter of the perpendicular jet can then be sized accordingly to balance the forces in opposing perpendicular directions, i.e., 1 inch (2.54 cm):

$$D(2)=\sqrt{1.25^2\cos(50.8°)}\approx 1''$$

For a lance tube with diameter less than 4 inches (101.6 cm), the distance between the jets is typically set to 6 times the straight nozzle throat diameter (Jet Spacing Distance), i.e., 6 inches (15.24 cm) to prevent the generation of strong turbulence between the jets, which is an undesired phenomenon that may adversely affect the cleaning performance of the sootblower:

$$\text{Jet Spacing Distance}=6(1.0'')=6\ \text{inches}(15.24\ \text{cm})$$

In practice, the nozzle angle can be as small as about 30° and as large as about 80°, but field testing indicates that about 50° appears to be the optimal angle for most conditions.

Figure 8:
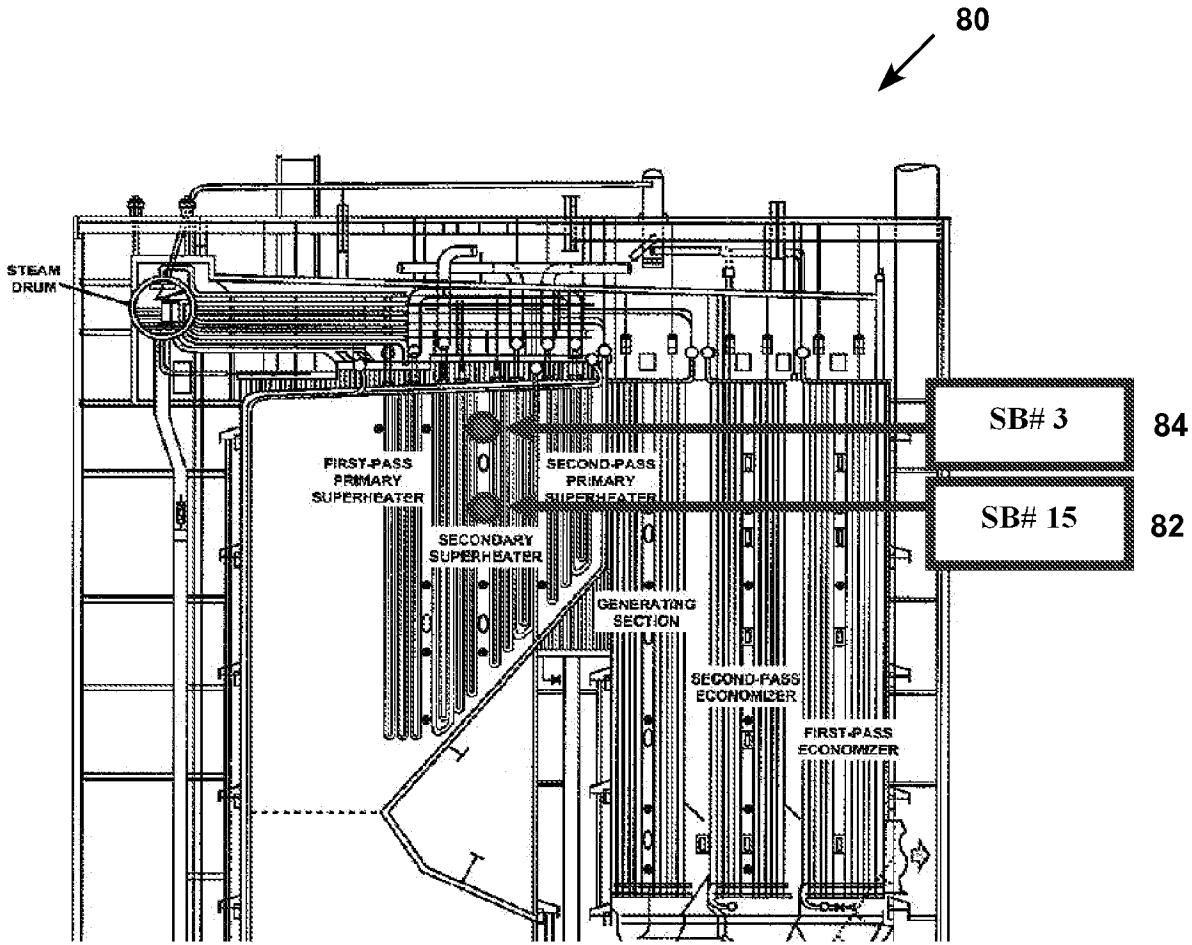
FIG. 8 is a conceptual illustration of the placement of angled-perpendicular sootblowers for a test of the technology.

FIG. 8 illustrates a boiler 80 and two locations 82, 84 where sootblowers with angled-perpendicular nozzles were installed for a mill trial of the present technology. The mill trial was performed on a B&W recovery boiler unit designed to burn 3.8 million lb/day (1721 ton/day) of black liquor dry solids (BLDS) and to produce 567,700 lb/hr (253,367 kg/hr) steam at 900° F. (482° C.) and 1525 psig (105 bars). The trial was divided into two stages. For the first stage, one conventional sootblower at location 82 in the secondary superheater was replaced with the new angled-perpendicular sootblower. The second stage involved replacing three additional sootblowers at location 82 as seen in FIG. 8, and two additional locations across the boiler and above locations 82 and 84, respectively.

Figure 9:
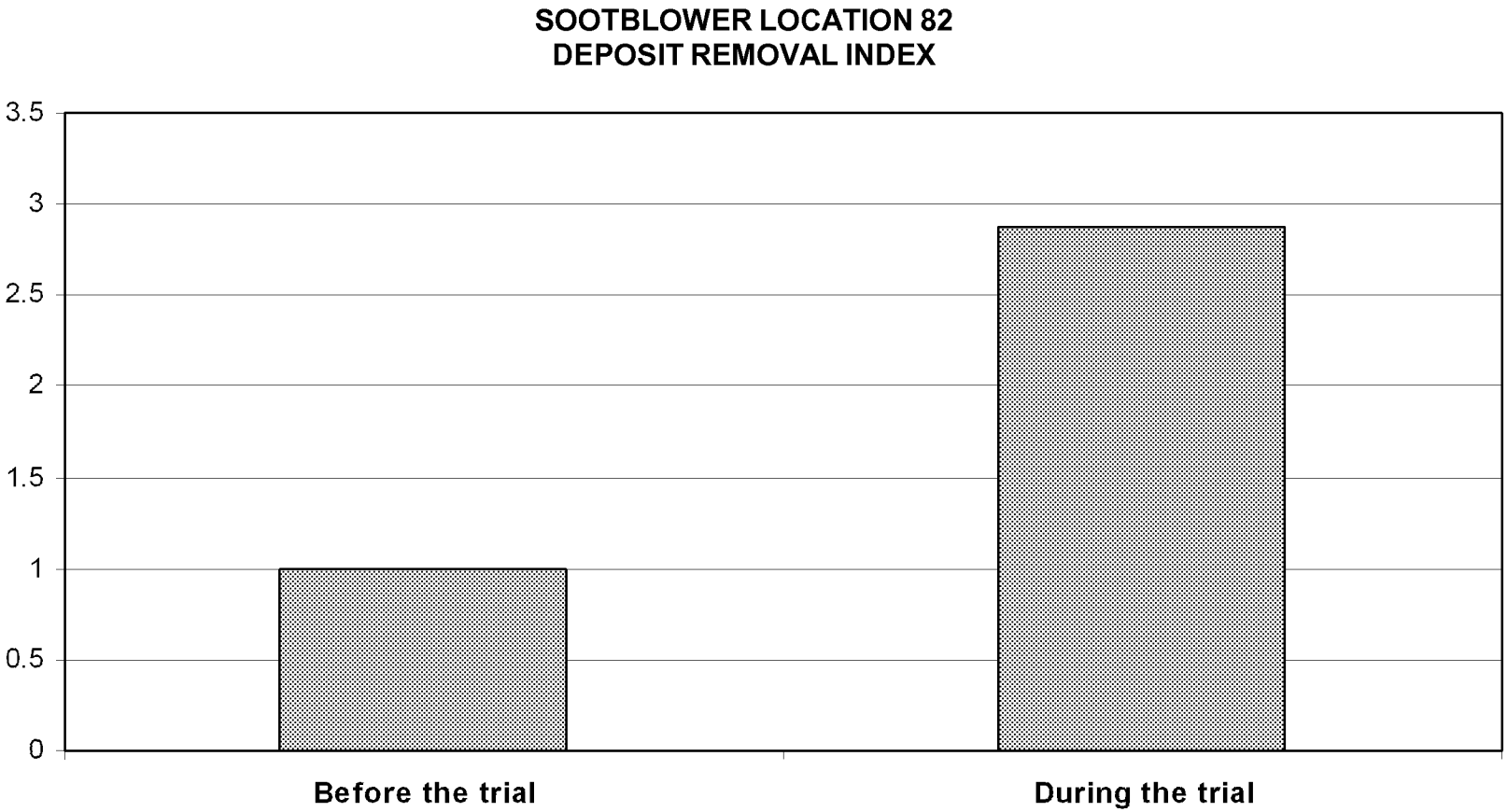
FIG. 9 is a graphical representation of test results for a sootblowers with an angled-perpendicular nozzle.

FIG. 9 shows the results of the first trial. The ability of the sootblower at location 82 to remove deposits was measured by a fouling monitoring system resident in the mill. The higher the deposit removal index, the greater the amount of deposit removed by the sootblower. Before the trial sootblower at location 82 had a deposit removal index of 1. During the trial, the removal index increases to 2.75, indicating that the new angled-perpendicular sootblower installed at location 82 removes substantially more deposits than its conventional sootblower counterpart.

Figure 10C:
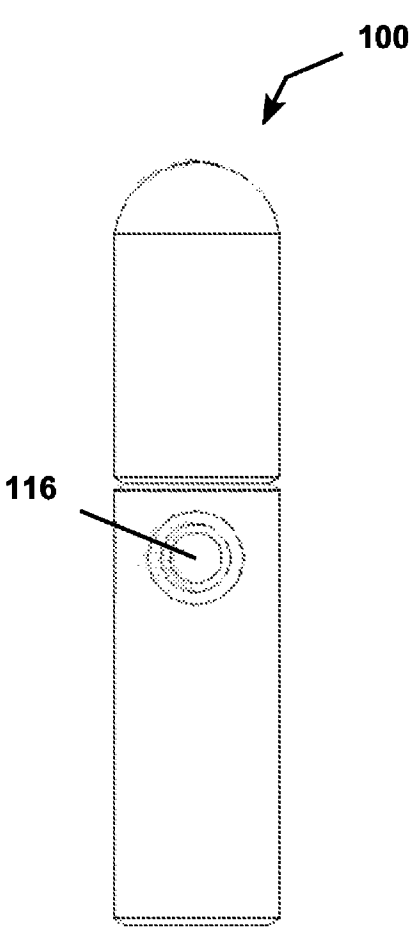
FIG. 10C is a rear view of the angled-perpendicular sootblower nozzle with three jets.
Figure 10B:
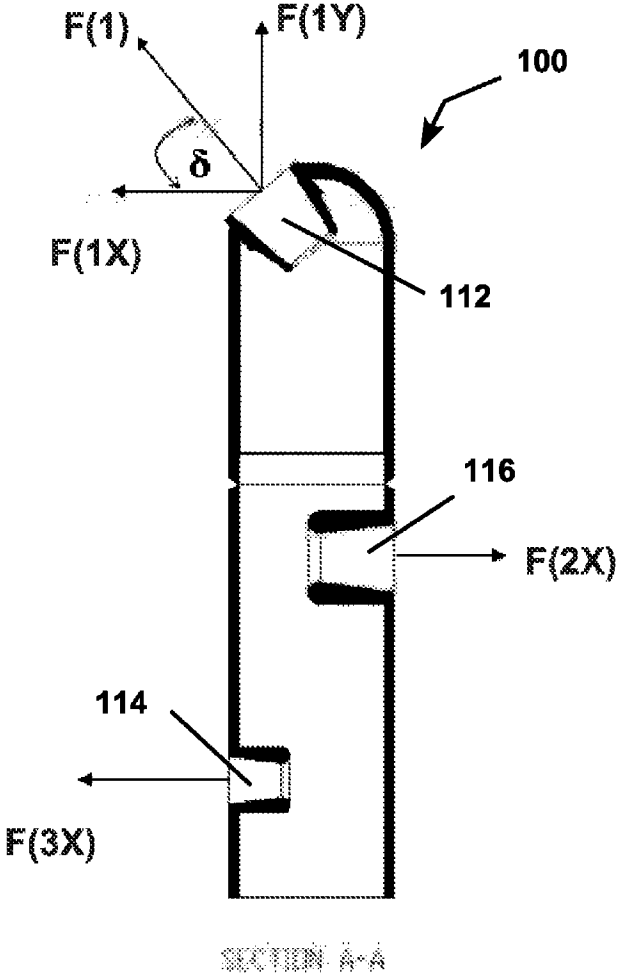
FIG. 10B is a cross-sectional side view of the angled-perpendicular sootblower nozzle with three jets.
Figure 10A:
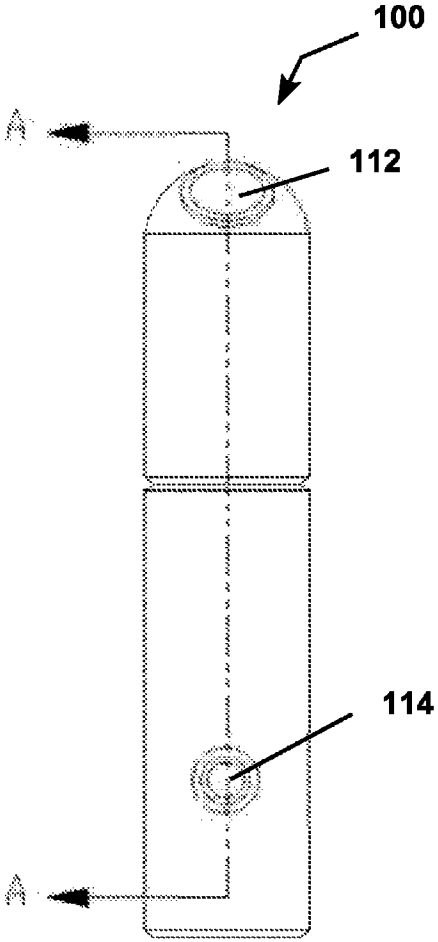
FIG. 10A is a front view of an angled-perpendicular nozzle with three jets for a sootblower for use in a boiler in an industrial power plant.

The principles of the present invention can be readily extended to sootblowers having nozzles with more than two jets. As a first example, FIGS. 10A-10C illustrate an angled-perpendicular nozzle 100 with one angled jet 112 and two perpendicular jets 114 and 116. The first perpendicular jet 114 is located on the same side of the nozzle with the angled jet 112, whereas the second perpendicular jet 116 is located on the opposing side of the nozzle from the angled jet 112. Therefore, the lateral force from the second perpendicular jet 116 is designed to balance the opposing lateral forces from the angled jet 112 and the first perpendicular jet 114. The equation to balance the resultant forces for the sootblower nozzle 100 is:

$$F(1\times)+F(3\times)=\beta(F2\times)$$

$$F1\cos\delta+F(3\times)=\beta(F2\times)$$

Figures 11A, 11B, 11C:
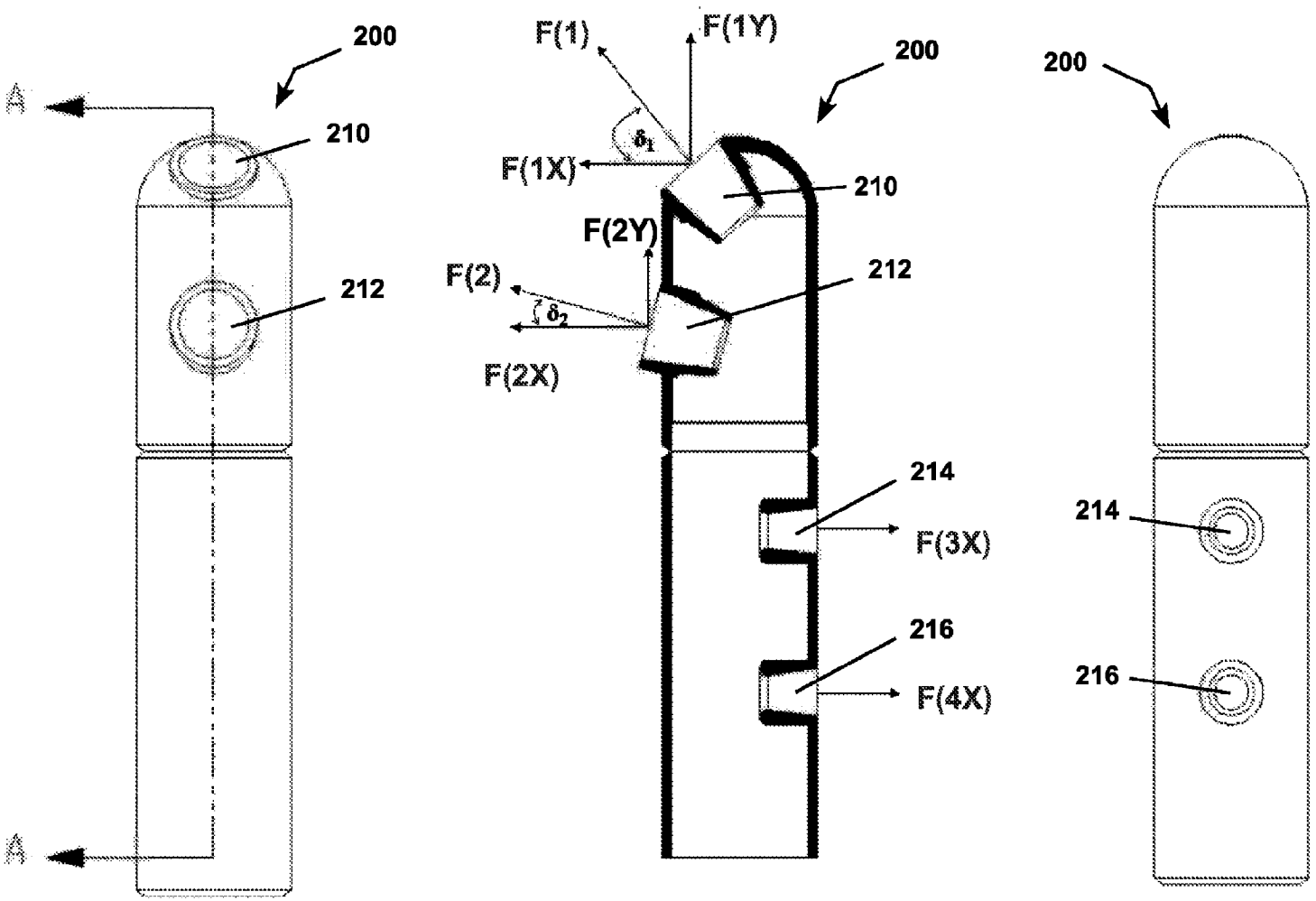
FIG. 11A is a front view of an angled-perpendicular nozzle with four jets for a sootblower for use in a boiler in an industrial power plant.
FIG. 11B is a cross-sectional side view of the angled-perpendicular sootblower nozzle with four jets.
FIG. 11C is a rear view of the angled-perpendicular sootblower nozzle with four jets.

As a second example, FIGS. 11A-11C illustrate an angled-perpendicular nozzle 200 with two angled jets 210 and 214 along with two perpendicular jets 214 and 216. The pair of angled jets 210 and 214 is located on the same side of the nozzle, whereas the pair of perpendicular jets 214 and 216 is located on the opposite side of the nozzle. Therefore, the lateral force from the two angled jets 210 and 214 is designed to balance the opposing lateral forces from the two perpendicular jets 214 and 216. The equation to balance the resultant forces for the sootblower nozzle 200 is $$F(1\times)+F(2\times)=\beta[F(3\times)+F(4\times)]$$

$$F(1)\cos\delta_1+F(2)\cos\delta_2=\beta[F(3\times)+F(4\times)]$$

It will be appreciated that the specific jet configurations shown above are representative but not exclusive examples of embodiments of the invention, and that the jets can be sized, angled and located in other combinations. It should also be apparent that the need to balance the resulting forces increases with the length (i.e., moment arm) of the sootblower. As a result, very short sootblowers may be somewhat unbalanced, whereas the very long sootblowers should be very closely balanced.

The invention claimed is:

1. An industrial boiler comprising a plurality of sootblowers, each sootblower having a major axis along a line of insertion and retraction defining an outward direction toward insertion and an inward direction toward retraction, each sootblower located adjacent to a leading edge of a respective platen bank in the boiler having a major axis, the sootblower comprising: a nozzle; a lance tube for supplying a flow of pressurized fluid to the nozzle; the nozzle comprising one or more deep reaching jets for emitting fluid aligned with the major axis of the platen bank for removing slag deposits inset from the leading edge of the platen bank; the nozzle further comprising one or more edge cleaning jets for emitting fluid angled with respect to the major axis of the platen bank for removing slag deposits on the leading edge of the platen bank and positioned to balance in an opposing perpendicular direction the fluid emitted from the one or more deep reaching jets to substantially eliminate the imposition of torque on the lance tube from the simultaneous emission of the fluid through the jets.

2. The industrial boiler of claim 1, wherein for each sootblower: the number of edge cleaning jets is one and the number of deep reaching jets is one; the number of edge cleaning jets is one and the number of deep reaching jets is two; or the number of edge cleaning jets is two and the number of deep reaching jets is two.

3. The industrial boiler of claim 1, wherein for each sootblower the number of edge cleaning jets is one and the number of deep reaching jets is one, and wherein: the edge cleaning jet is located outward of the deep reaching jet and directed outward; the edge cleaning jet is located outward of the deep reaching jet and directed inward; the edge cleaning jet is located inward of the deep reaching jet and directed outward; or the edge cleaning jet is located inward of the deep reaching jet and directed inward.

4. The industrial boiler of claim 1, wherein for each sootblower: the number of edge cleaning jets is one; the number of deep reaching jets is two; the edge cleaning jet and a first deep reaching jet are located on a side of the nozzle; and the second deep reaching jet is located on an opposing side of the nozzle.

5. The industrial boiler of claim 1, wherein for each sootblower: the number of edge cleaning jets is two; the number of deep reaching jets is two; the edge cleaning jets are located outward of the outward most deep reaching jet; and the edge cleaning jets are directed outward; the deep reaching jets are located on an opposing side of the edge cleaning jets.

6. The industrial boiler of claim 1, wherein for each sootblower at least one edge cleaning jets is directed approximately 50 degrees with respect to the major axis of the platen bank.

7. The industrial boiler of claim 1, wherein for each sootblower at least one edge cleaning jet is directed within the range of approximately 30 degrees to approximately 80 degrees with respect to the major axis of the platen bank.

8. The industrial boiler of claim 1, wherein for each sootblower the pressurized fluid comprises steam, air, or water.

9. The industrial boiler of claim 1, wherein the one or more edge cleaning jets have larger diameters than the one or more deep reaching jets at the respective ends of the jets where the flow of pressurized fluid exits the jets.

10. The sootblower of claim 1, wherein the one or more edge cleaning jets have larger diameters than the one or more deep reaching jets at the respective ends of the jets where the flow of pressurized fluid exits the jets.

11. A sootblower in or for an industrial boiler, the sootblower having a major axis along a line of insertion and retraction defining an outward direction toward insertion and an inward direction toward retraction, comprising: a nozzle; a lance tube for supplying a flow of pressurized fluid to the nozzle; the nozzle comprising one or more perpendicular jets for emitting fluid perpendicular to the major axis; and the nozzle comprising one or more angled jets for emitting fluid angled with respect to perpendicular to the major axis of the sootblower and positioned to balance in an opposing perpendicular direction the fluid emitted from the one or more perpendicular jets to substantially eliminate the imposition of torque on the lance tube from the simultaneous emission of the fluid through the jets.

12. The sootblower of claim 11, wherein: the number of angled jets is one and the number of perpendicular jets is one; the number of angled jets is one and the number of perpendicular jets is two; or the number of angled jets is two and the number of perpendicular jets is two.

13. The sootblower of claim 11, wherein the number of angled jets is one and the number of perpendicular jets is one, and wherein: the angled jet is located outward of the perpendicular jet and directed outward; the angled jet is located outward of the perpendicular jet and directed inward; the angled jet is located inward of the perpendicular jet and directed outward; or the angled jet is located inward of the perpendicular jet and directed inward.

14. The sootblower of claim 11, wherein: the number of angled jets is one; the number of perpendicular jets is two; the angled jet and a first perpendicular jet are located on a side of the nozzle; and the second perpendicular jet is located on an opposing side of the nozzle.

15. The sootblower of claim 11, wherein: the number of angled jets is two; the number of perpendicular jets is two; the angled jets are located outward of the outward most perpendicular jet; and the angled jets are directed outward; the perpendicular jets are located on an opposing side of the angled jets.

16. The sootblower of claim 11, wherein at least one angled jets is directed approximately 50 degrees with respect to perpendicular to the major axis of the sootblower.

17. The sootblower of claim 11, wherein at least one angled jet is directed within the range of approximately 30 degrees to approximately 80 degrees with respect to perpendicular to the major axis of the sootblower.

18. The sootblower of claim 11, wherein the pressurized fluid comprises steam, air, or water.

19. A method for cleaning an industrial boiler comprising a plurality of platen banks, each platen bank having a major axis, comprising the steps of: installing a plurality of sootblowers in the boiler, each sootblower having a major axis along a line of insertion and retraction, each sootblower located adjacent to a leading edge of a respective platen bank; configuring each sootblower with a nozzle and a lance tube for supplying a flow of pressurized fluid to the nozzle; configuring each nozzle with one or more deep reaching jets for emitting fluid aligned with the major axis of its respective platen bank for removing slag deposits inset from the leading edge of the platen bank; further configuring each nozzle with one or more edge cleaning jets for emitting fluid angled with respect to the major axis of its respective platen bank for removing slag deposits on the leading edge of the platen bank, wherein the one or more edge cleaning jets have larger throat diameters than the one or more deep reaching jets; for each sootblower, supplying pressurized fluid while inserting, rotating, and retracting the sootblower to remove slag deposits from its respective platen bank; and for each sootblower, sizing the jets to balance forces lateral to the major axis of the sootblower resulting from emission of the fluid to substantially eliminate the imposition of torque on the lance tube from the simultaneous emission of the fluid through the jets.

* * * * *